US007934624B2

(12) United States Patent
Seelhofer

(10) Patent No.: US 7,934,624 B2
(45) Date of Patent: May 3, 2011

(54) CONTAINER CLOSURE FOR SIMULTANEOUSLY POURING OUT TWO SEPARATE LIQUIDS WITH A SPECIFIED QUANTITATIVE RATIO

(75) Inventor: Fritz Seelhofer, Lindau (CH)

(73) Assignee: Belcap Switzerland AG, Neuhausen am Rheinfall (CH)

( * ) Notice: Subject to any disclaimer, the term of this patent is extended or adjusted under 35 U.S.C. 154(b) by 444 days.

(21) Appl. No.: 12/084,666

(22) PCT Filed: Nov. 7, 2006

(86) PCT No.: PCT/CH2006/000624

§ 371 (c)(1),
(2), (4) Date: Jul. 29, 2008

(87) PCT Pub. No.: WO2007/053970

PCT Pub. Date: May 18, 2007

(65) Prior Publication Data

US 2009/0026222 A1 Jan. 29, 2009

(30) Foreign Application Priority Data

Nov. 8, 2005 (CH) ..... 1787/05

(51) Int. Cl.
*B67D 7/74* (2010.01)

(52) U.S. Cl. ..... 222/129; 215/6; 220/521

(58) Field of Classification Search ..... 222/129, 222/94, 145.1; 220/521–526; 215/6, 265
See application file for complete search history.

(56) References Cited

U.S. PATENT DOCUMENTS

| | | | | |
|---|---|---|---|---|
| 1,418,814 | A * | 6/1922 | Lutz et al. | 215/6 |
| 3,200,995 | A * | 8/1965 | Gangwisch | 222/94 |
| 4,585,149 | A * | 4/1986 | Zulauf | 222/94 |
| 5,328,056 | A * | 7/1994 | Schneider et al. | 222/94 |
| 6,129,234 | A * | 10/2000 | Culig et al. | 220/573.1 |
| 6,176,395 | B1 * | 1/2001 | Abbott et al. | 222/94 |
| 6,200,295 | B1 * | 3/2001 | Burchett et al. | 604/218 |
| 6,997,353 | B2 * | 2/2006 | Decottignies et al. | 222/105 |
| 7,435,027 | B2 * | 10/2008 | Hetzel | 401/47 |
| 2004/0211742 | A1 * | 10/2004 | Deans | 215/6 |

* cited by examiner

*Primary Examiner* — Lien T Ngo
(74) *Attorney, Agent, or Firm* — Yi Li

(57) ABSTRACT

The invention serves to simultaneously pour out two separate liquids with a specified quantitative ratio from a container. To this end, a separate container is located inside said container. The container closure forms a mouth cap (1). This tapers upward conically into a straight concentric spout (2) with an interior space (11). A larger, closeable spout neck (4) having a projection (5) that radially projects at the bottom is placed concentrically around the straight spout (2) of the mouth cap (1). This projection (5) is supported with supporting braces (6) an the shoulder (7) formed by the conical taper. A flow opening (9), which encircles up to the supporting braces (6), is left open between the shoulder (7) and the inside edge (8) of the projection (5) and of the larger spout neck (4). The supporting braces (6) and the radial projection (5) are each passed through by a borehole (10) that communicate with the inside of the mouth cap (1) and with the space (16) outside the larger spout neck (4). When the container is tilted, the separate contents are poured out with a specified ratio.

13 Claims, 9 Drawing Sheets

Figure 1:
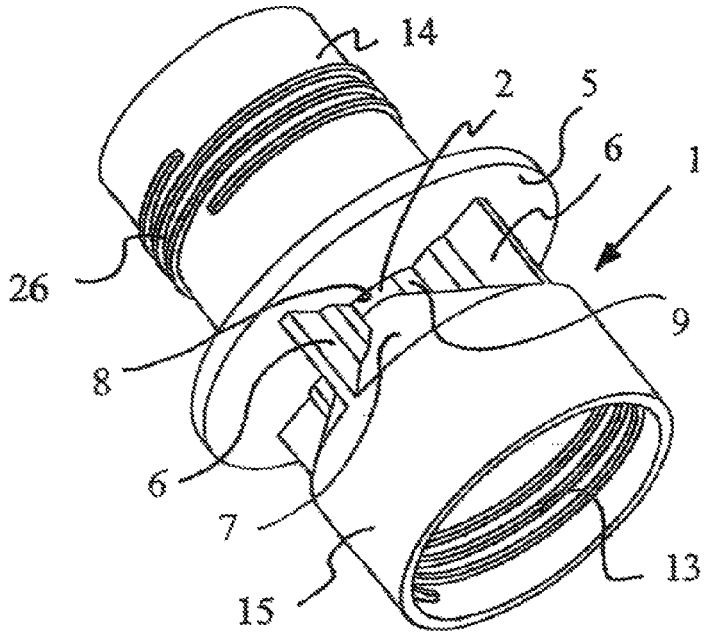

CONTAINER CLOSURE FOR SIMULTANEOUSLY POURING OUT TWO SEPARATE LIQUIDS WITH A SPECIFIED QUANTITATIVE RATIO

This invention concerns a container closure for simultaneously pouring out two separate liquids with a specified quantitative ratio, in which the pouring out can be interrupted and resumed again anytime. There are containers, which, for example, contain a first liquid and there is a second liquid container inside this container, in which this separate inner container then contains a second, different liquid. The inner container can be made somewhat smaller than the outer container and can be arranged hanging in it, that is, be held hanging in the closure system, so that it is arranged concentric to the outer container stretching towards the bottom. These two separate and different liquids can be all kinds of chemicals, which should be first mixed together for the pouring or also drinkable liquids, for example, all kinds of fruit juices and lemonades, which should be perhaps directly mixed with an alcoholic drink for drinking.

Now a container closure is desired, which permits a simultaneous and continuous pouring of the two different contents, so that they are poured out in a specified, constant quantitative ratio. This should ensure that both separate containers, that is, both the outer as well as the inner containers, become empty simultaneously as far as possible. Moreover, the liquid stream should remain bubble-free and the actual container closure should be made out of as few parts as possible and be assembled as economically as possible. The liquid stream should be interrupted abruptly with the interruption of the pouring position of the container so that no content of the inner container flows back into the outer container and also no content can flow back from the outer container into the inner.

The task of the present invention is therefore to produce a container closure to simultaneously pour out two separate liquids with a specified quantitative ratio, which consists of a minimum number of parts and can be assembled economically. Besides, this closure should fulfil the above-mentioned requirements and should also be possible to be executed as tamperproof closure.

This problem is solved by a container closure to simultaneously pour out two separate liquids with a specified quantitative ratio from a container, inside which there is a separate container, in which the container closure is, characterised by the fact, that it forms a mouth cap for the receiving and holding of the inner container and pouring out its contents, which tapers upward conically into a straight concentric spout with an interior space, and that a larger, closable spout neck having a projection that radially projects at the bottom is placed concentrically around the straight spout of this mouth cap, in which this projection is supported with at least two supporting braces on the shoulder formed by the conical taper and a flow opening, which encircles up to the supporting braces, is left open between this shoulder on one side and the inside edge of the projection and of the larger spout neck on the other side, and that the supporting braces and the radial projection are passed through by at least one hole, each of which communicate with the inside of the mouth cap and with the space outside the larger spout neck so that, the liquid flowing out from outside the inner container is deflected sideways at least twice in its flow direction till the discharge from the closure.

This container closure to pour out two separate liquids with a specified quantitative ratio from a container is represented in the figures in different views. The closure is described individually based on these figures and its function is explained.

Figure 2:
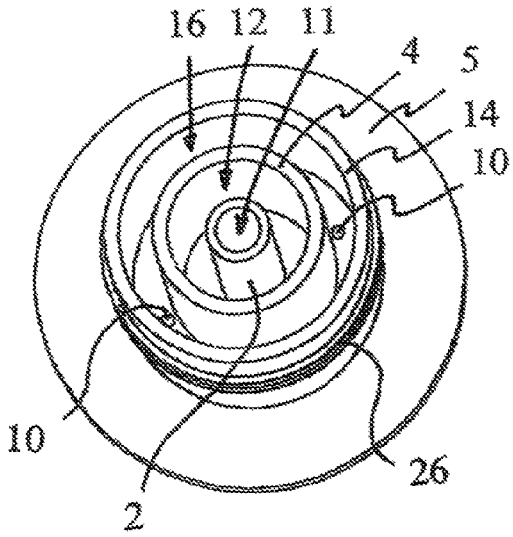
Figure 3:
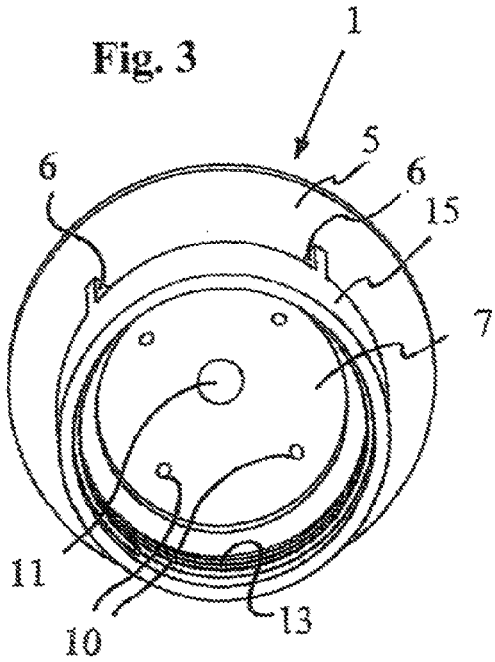
Figure 4:
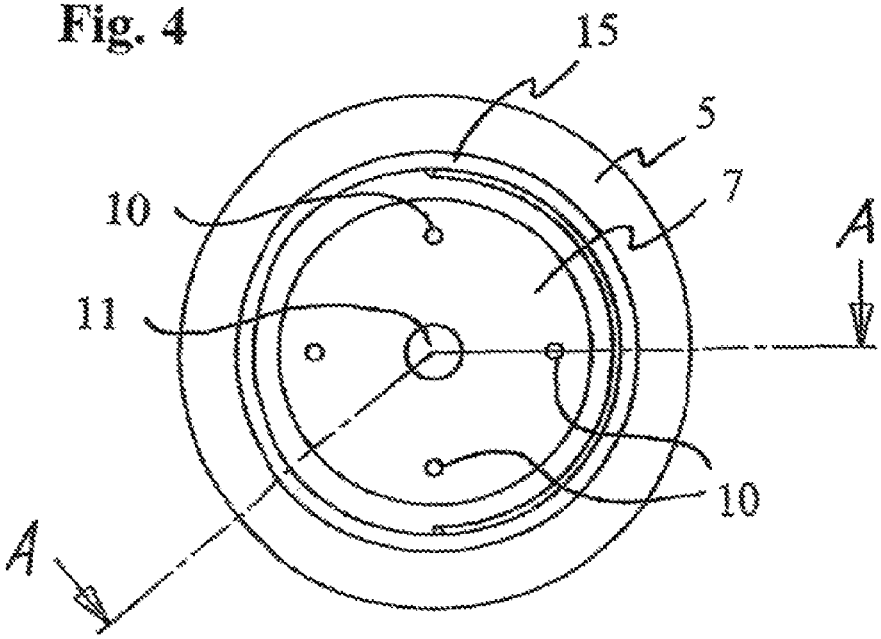
Figure 5:
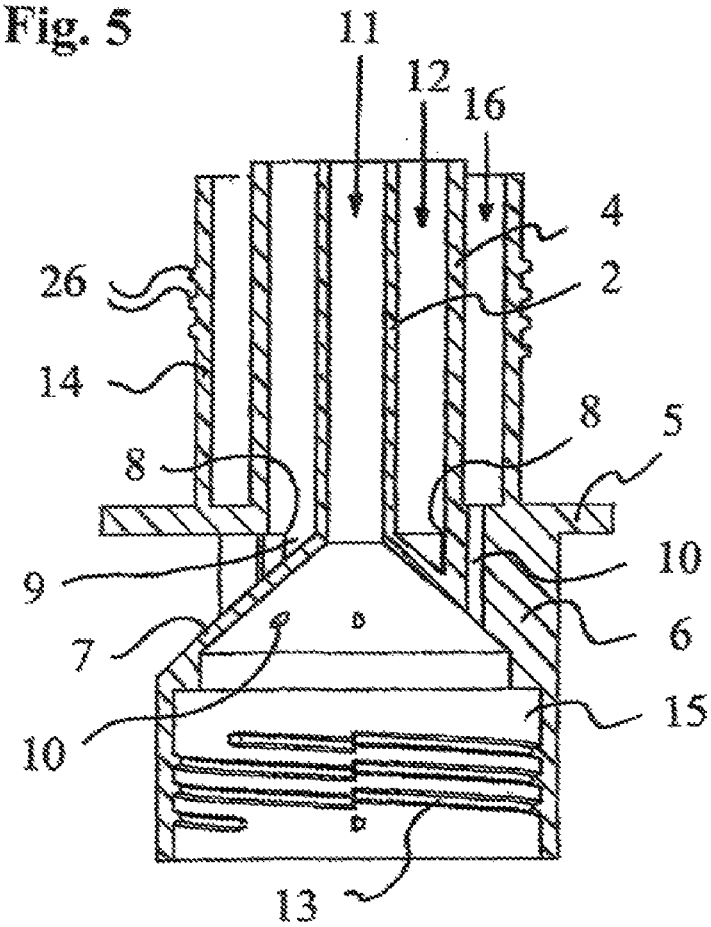
Figure 6:
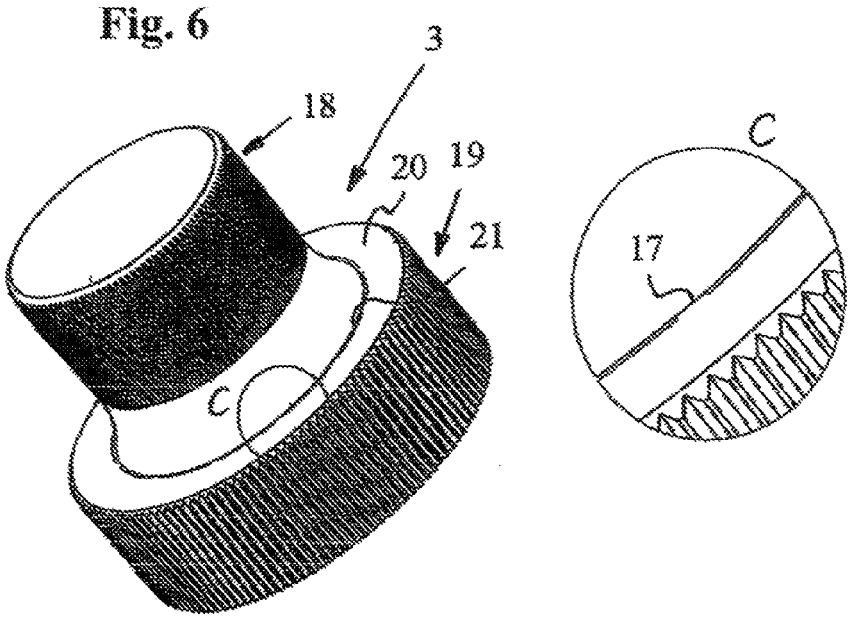
Figure 7:
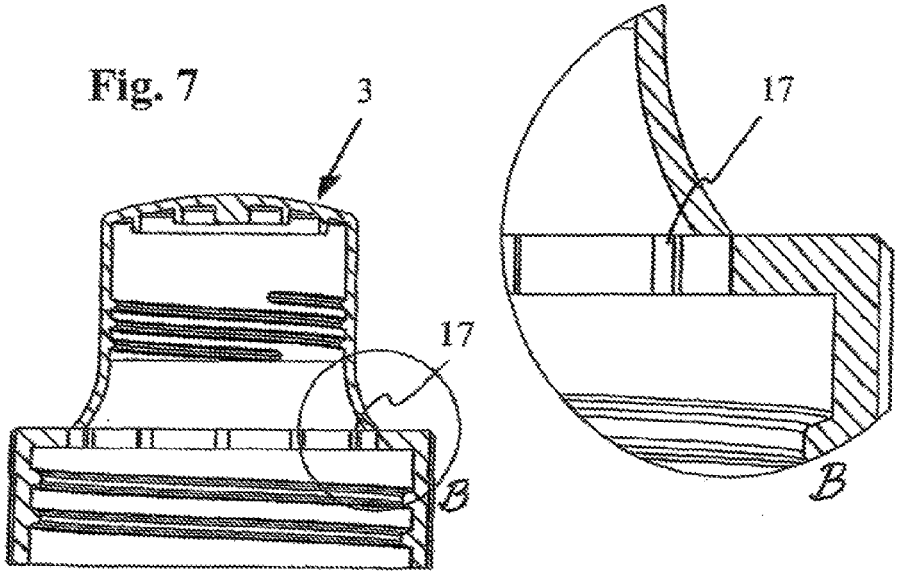
Figure 8:
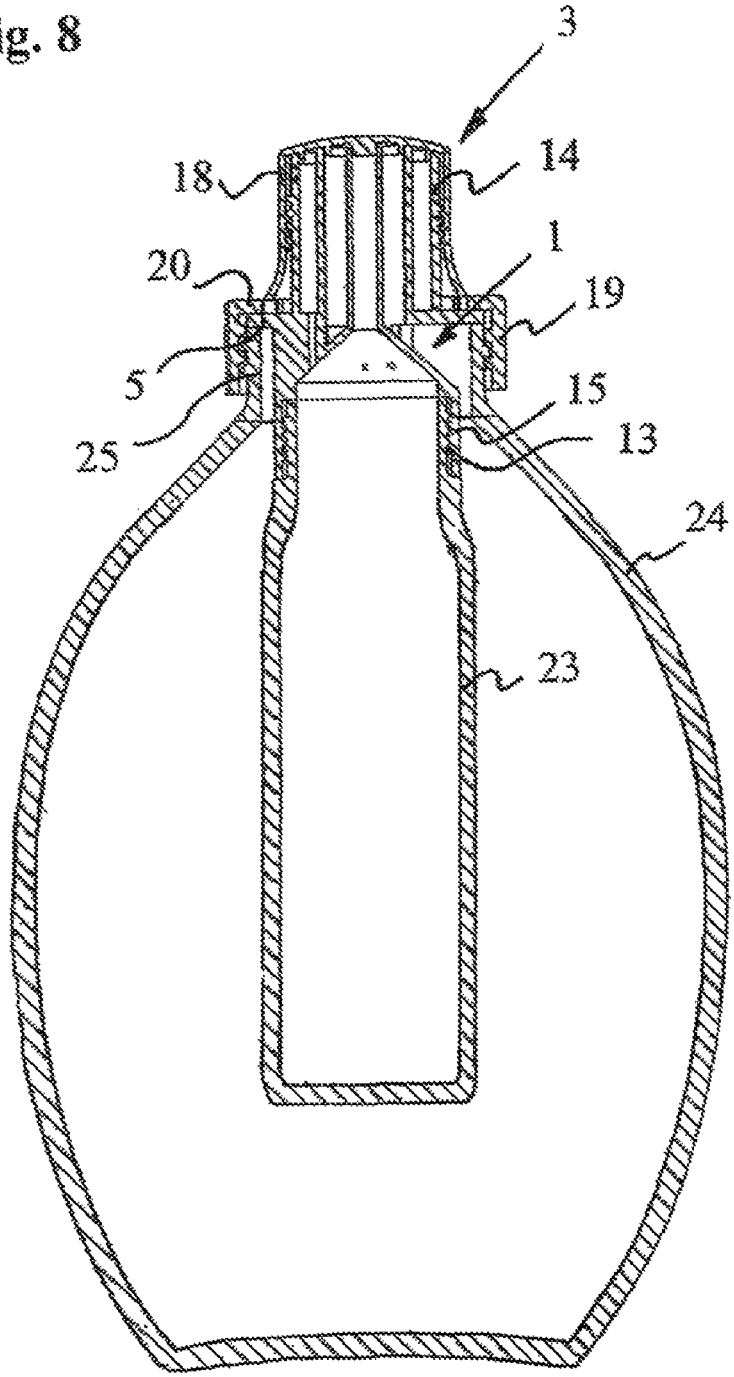
Figure 9:
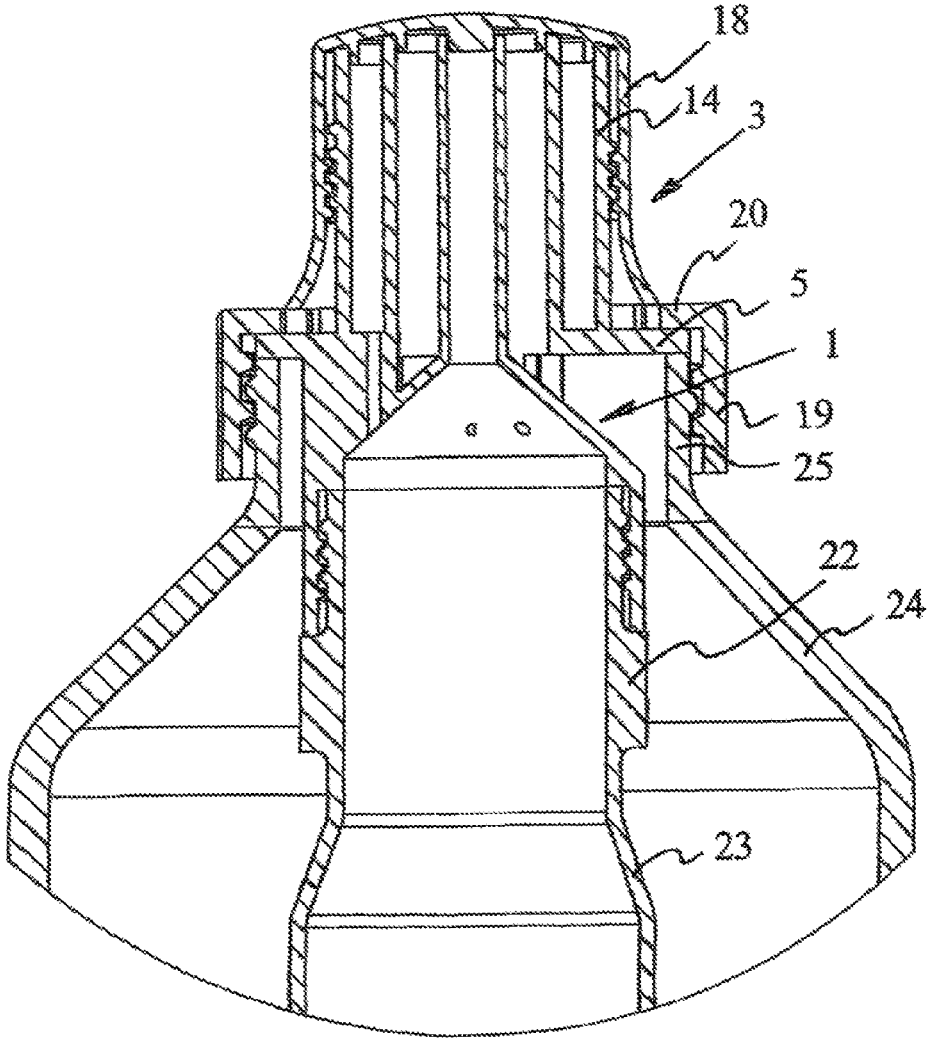

The figures show:

FIG. 1 The container closure in a perspective view seen obliquely from below;

FIG. 2 The container closure seen obliquely from above;

FIG. 3 The container closure seen obliquely from below;

FIG. 4 The container closure seen from below with section line A-A drawn;

FIG. 5 The container closure in a section seen from the side along the section line A-A shown in FIG. 4;

FIG. 6 The perspective view of closure cap of the container closure from above represented obliquely and beside that the detailed section C;

FIG. 7 The closure cap of the container closure in a diametrical section and beside that the detailed section B;

FIG. 8 The container closure fitted with closure cap assembled on a container with inner container for a second, separate liquid, also represented in a diametrical section;

FIG. 9 The container closure fitted with closure cap according to FIG. 8 in the detailed section C.

Figure 10:
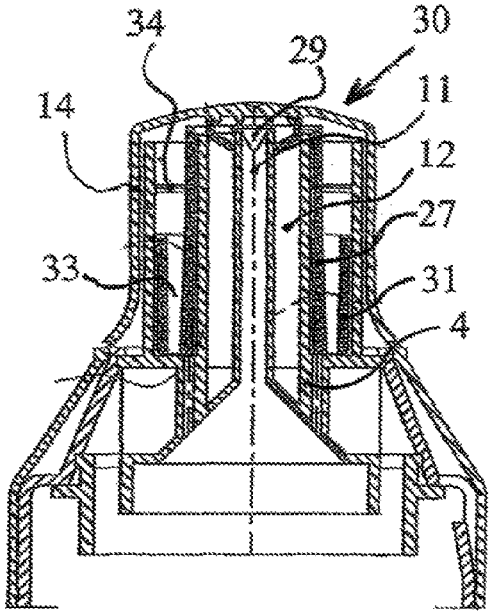
Figure 11:
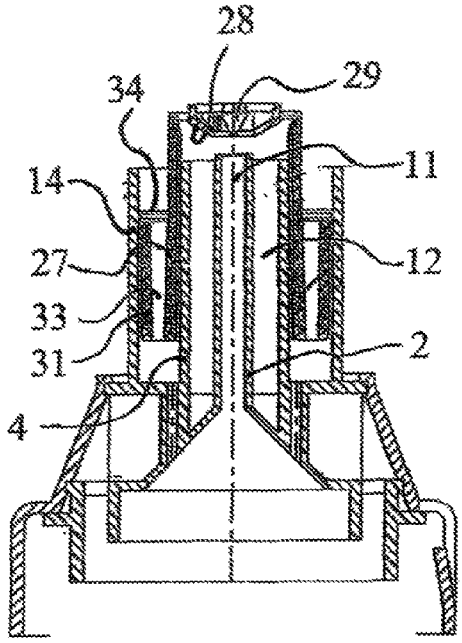
Figure 12:
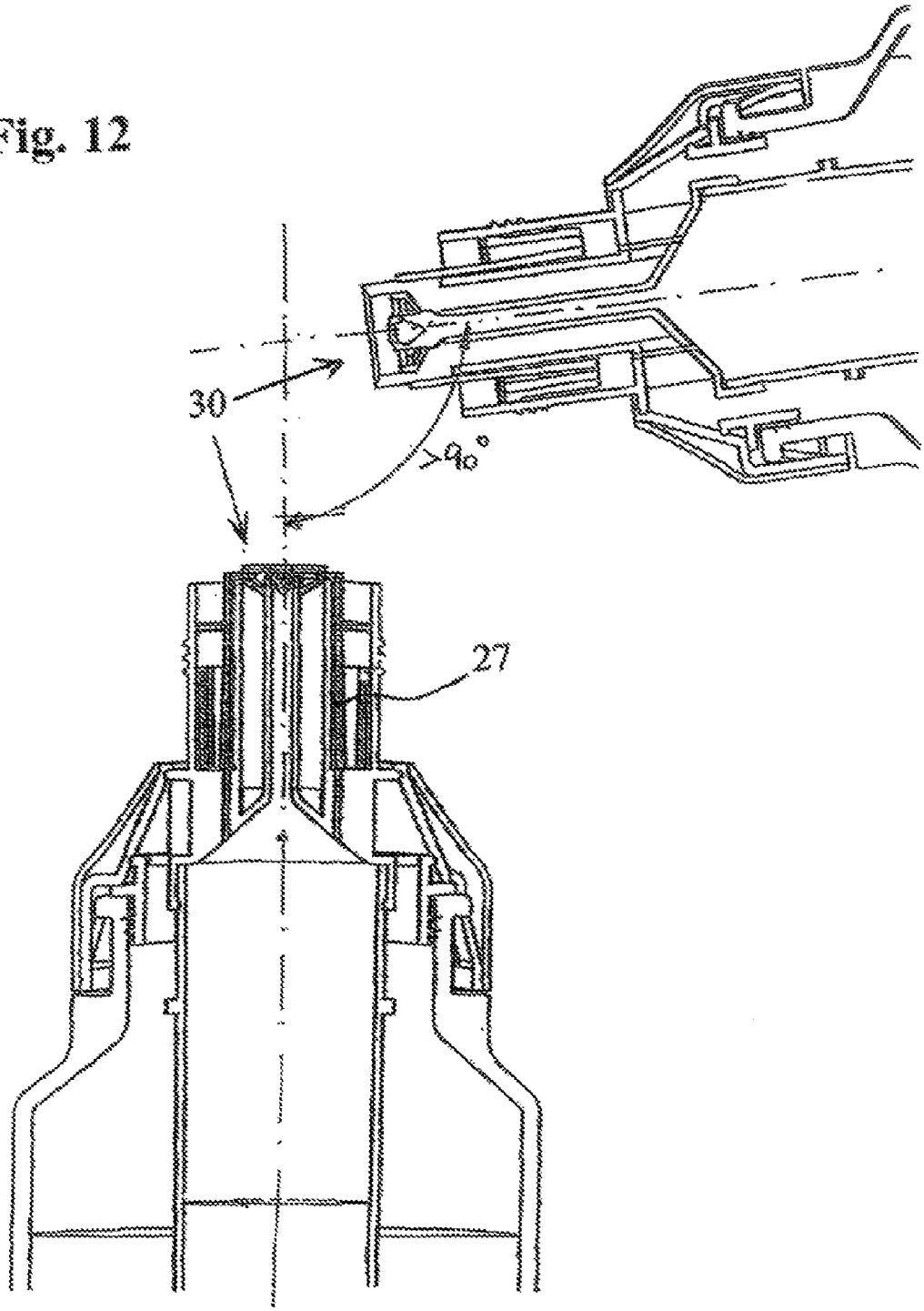
Figure 13:
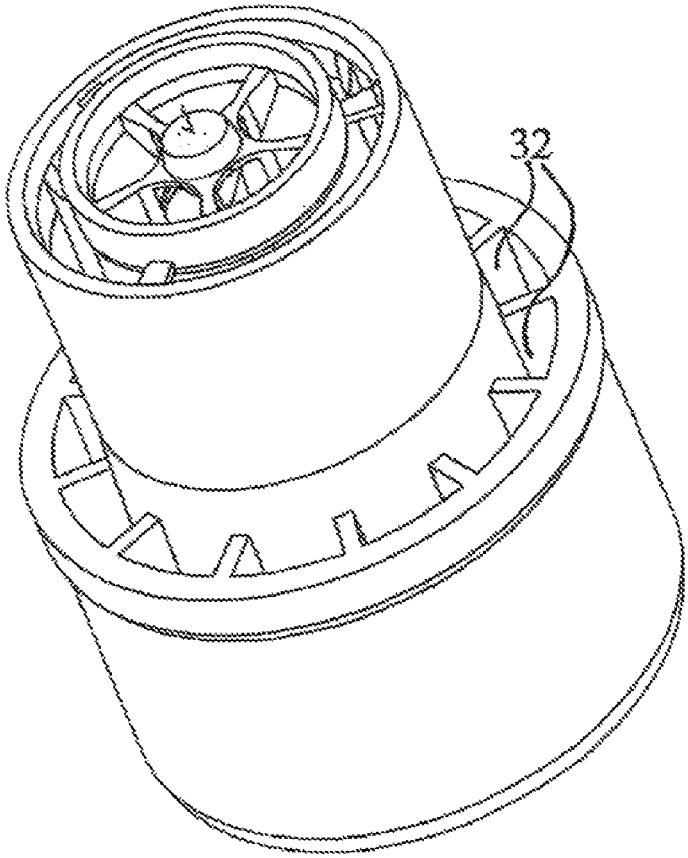
Figure 14:
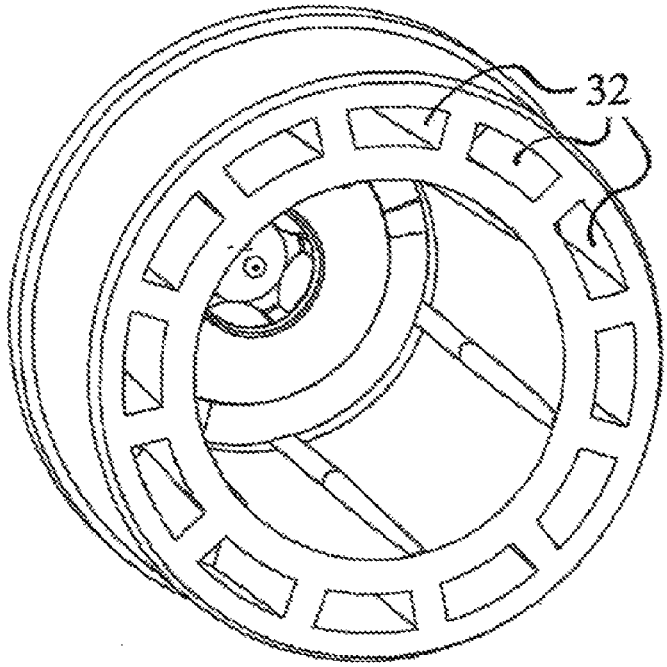

FIG. 10 The container closure equipped with an additional sealing element with the sealing element in the sealing condition;

FIG. 11 The container closure with the additional sealing element with the sealing element in the open condition;

FIG. 12 The container closure with the additional sealing element, once in upright position of the container and once in pouring position of the same;

FIG. 13 A perspective view of the sealing element seen from front;

FIG. 14 A perspective view of the sealing element seen from behind.

This container closure is suitable for pouring out two separate liquids with a specified quantitative ratio from a container, inside which there is a separate container. As can be seen from FIG. 1, this container closure consists of a mouth cap 1 for the receiving and for the holding of the inner container and for the pouring out of the contents both of this inner as well as an outer container. This mouth cap 1 tapers upwards conically and forms consequently a shoulder 7. It then changes over to a straight, concentric spout 2. A larger spout neck is formed concentric to this straight spout 2 of the mouth cap 1, which however cannot be seen here, since a further concentric connection 14 with external thread 26 extends concentrically around it. The radially projecting projection 5 is formed at its bottom end, in which this projection 5 is supported with at least two supporting braces 6 on the shoulder 7 formed by the conical taper. In the example shown, there are four supporting braces 6 arranged distributed around the circumference. However, there can also be merely two, three or even more than four supporting braces. A flow opening 9, which encircles up to the supporting braces 6, remains open between the shoulder 7 on one side and the inside edge 8 of the projection 5 and the larger connection connecting towards the top on the other side. The supporting braces 6 and the radial projection 5 are each passed through by at least one hole, which communicate with the inside of the mouth cap 1 and the space outside the spout neck not visible here and the inside of the threaded connection 14. The threaded sleeve 15, which is formed at the bottom side of the mouth cap 1, serves to hold with its internal thread 13 an inner container or an inner bottle inside an outer container or an outer bottle.

FIG. 2 shows the container closure seen obliquely from above. One can see here the projection 5 and the larger spout neck 4 formed on it as well as the concentric threaded connection 14 arranged concentrically around it. The interior 11 of the inner spout 2 communicates thereby with the inner container or the inner bottle, while the interior 12 of the larger spout neck 4 communicates with the interior of the outer container or the outer bottle. Starting from the upper side of the projection 5, holes 10 lead towards the bottom through the supporting braces 6 (not visible here) and into the inner container or the inner bottle. These holes 10 take care that, during the pouring out, exactly so much air flows into the inner container that the correct amount of fluid flows out per unit time and a simultaneous discharging with the outer container or the outer bottle is ensured.

In FIG. 3, one can see the mouth cap I from below inside the threaded sleeve 15 with its internal thread 13. Here, the holes 10 can be seen on the bottom side of the shoulder 7, four numbers in the example. These lead through the four supporting braces 6, likewise arranged distributed around the circumference, outwards into the space outside the larger spout neck 4, but however within the threaded connection 14. In FIG. 4, one can see the container closure seen directly from below with section line A-A drawn and one can see the inside 1 of the spout as well as the holes 10 on the bottom side of the shoulder 7.

The FIG. 5 shows the container closure in a section from the side along this section line A-A as drawn in FIG. 4. This sectional view gives a view into the inside structure of the container closure 1. One can see first the threaded sleeve 15 with its internal thread 13 at the bottom. The external thread of a container connection is screwed in this internal thread 13, namely the thread of an inner container or an inner bottle. The threaded sleeve 15 tapers conically to a smaller diameter on its upper side and consequently forms a conically tapering shoulder 7 and finally tapers off to a reduced spout 2. A larger spout neck 4 arranged concentrically around the inner spout 2 is formed on the shoulder 7, which is held on individual supporting braces 6 or supporting elements. A flat projection 5 stretches radially outwards at the bottom end of the spout neck 4. A further threaded connection 14 with external thread 26 is formed on this, on which a relevant closure cap can be screwed on. Holes lead from the space 16 between the inner side of this threaded connection 14 and the outer side of the larger spout neck 4 towards the bottom, go through the supporting braces 6 lying under that and open out finally at the bottom side of the shoulder 7 into the inner container or the inner bottle. There is a gap between the bottom inner edge of the spout neck 4 and the outer edge of the spout 2 so that a circumferential outlet opening is formed, which is interrupted only by the individual supporting braces 6. The liquid, which is in the outer container or in the outer bottle, consequently flows between the shoulder 7 and the bottom side of the projection 5 into the outlet opening 9 during the pouring out and then between the outside of the inner spout 2 and the inside of the spout neck 4 towards the outside. Therefore, it experiences a direction change twice on its way towards the outside. But, at the same time, the liquid flows out from the inner container or the inner bottle of the bottom side of the shoulder 7 here to the central spout 2. The inner container or the inner bottle is thereby supplied with air from outside through the holes 10. The dimensioning of these holes 10 is decisive for the quantity poured out per unit time. This is dimensioned in such a way that a simultaneous discharging is ensured according to the ratio of size of the inner container to the outer container or inner bottle to the outer bottle.

As one can see further in FIG. 5, the mouths of the spout 2 and the larger spout neck 4 arranged concentrically around it lie in the same level and have sharp mouth edges, which firstly facilitates the abrupt discontinuation of the pouring out and also prevents the fluid reaching from one connection to the other. The mouth of the threaded connection 14 lying concentrically around the larger spout neck 4 on the radial projection 5 is slightly set back against the mouth of the spout neck 4 so that the inner plane of a closure lid that can be screwed on to the threaded connection 14 can be pressed sealed the mouths of spout neck 4 and inner spout 2 by means of screwing on. In a further variation, not shown here, the outer threaded connection on the projection 5 can be omitted. In this case, the larger spout neck 4 itself is provided with an external thread, to which a suitable closure cap can be screwed on directly.

FIG. 6 shows the special closure cap 3 belonging to the container closure. It consists of a closure lid 18 and a closure cap sleeve 19 of different diameter. The closure cap sleeve 19 serves to press the radial projection 5 of the container closure with its shoulder 20 on the connection of the container to be fitted or the bottle to be fitted. The closure cap 3 widens at its bottom edge in the form of a trumpet-like mouth and bottoms out in the shoulder 20 of the closure cap sleeve 19 via a surrounding perforation line 21 working as initial tamper-proof guarantee, which acts as clamping sleeve, and which can be put on from above via the radial projection 5 of the container closure. The closure 1 is pressed on the mouth of the container to be made leak-proof by screwing on to the container connection. For this, the closure cap sleeve 19 is provided with a thread with locking teeth, which while screwing on to the thread of the container connection engage in identical locking teeth on the same. The closure 18 serves for the opening and again closing of the container closure. The two parts 18,19 are connected with each other solely via the perforation line 21, that is, via only few material bridges 17, as is shown in the enlarged detailed view C right next to the FIG. 6.

In FIG. 7, a diametrical section through this closure cap 3 is represented. Both the upper closure lid 18 as well as the lower closure cap sleeve 19 has an internal thread. A detailed view of the section B is shown to the right beside the sectional drawing, namely the transition of the upper closure lid 18 to the lower closure cap sleeve 19, which is implemented only via a few weak material bridges 17, so that the material bridges 17 form a tamper-proof arrangement. These bridges 17 are broken during the initial opening or unscrewing of the closure lid 18.

Finally, FIG. 8 represents the container closure 1 with closure cap 3 put on a container or a bottle with a separate inner container 23 for the second, separate liquid, also in a diametrical section. The inner bottle 23 is screwed to the internal thread 13 of the threaded sleeve 15 of the container closure 1. Then the inner bottle 23 was put inside the outer container 24 hanging on the container closure 1, after which finally the radial projection 5 of the container closure rests on the connection edge of the outer container 24. Now the closure cap 3 was put on and thereafter its shoulder 20 tightly presses the radial projection 5 of the container closure 1 on the connection of the larger container 24. The upper threaded cap 18 can be now separated from the lower threaded cap 19 breaking the material bridges and be unscrewed from the threaded extension 14 of the container closure, after which the two liquids in the larger container 24 and in the inner container 23 can be poured out simultaneously with an exactly predetermined ratio. The detail C of this FIG. 8 is represented in enlarged view in FIG. 9.

In the embodiment according to FIG. 10, the container closure is fitted with an additional sealing element 30. This is shown here in the sealed condition. It has the following purpose: If the container or the container bottle, which is fitted with such a container closure to pour out simultaneously two separate liquids with a specified quantitative ratio, which does not include any such sealing element, and then the bottle or the container is tilted slowly from the upright position to the pouring out position and is thereby held merely somewhat horizontal, then one liquid, which is in the outer container, begins to flow out, while the liquid from the inner container does not flow out for the time being. The container closure acts, namely for the simultaneous pouring out, reliably only if the container bottle is held somewhat at an angle of 30° or steeper. The additional sealing element 30 now causes that a pouring out occurs only if the bottle is tilted sufficiently. For this, the sealing element 30 is carried in the area outside the external connection 4. It consists of a tube 27, which is carried around this outer connection 4 and is closed in the front and two sealing surfaces 28, 29 are formed on the inner side of this closure. One sealing surface 29 is executed as a cone and serves as shown for the closing of the inner spout neck 2, while the outer sealing surface 28 is also formed conical and can be penetrated into the outer connection 4 and closes the same leak-proof. A second somewhat larger tube 31 is formed on the sealing element 30 around the tube 27 concentric to it outside the connection 4, which is connected to the smaller tube 27 via some radial bridges 32 (FIG. 13,14). However, only the space 33 between these bridges 32 can be seen here. The outer tube 31 tapers towards outside slightly conical against the top or outside. Grooves 34 are formed in the inner side of the threaded connection 14. If the tube 27,31 is pressed from above into this threaded connection 14 for the assembly, the upper end edge of the outer tube 31 finds a stop at this groove 34 afterwards and can be henceforth moved in and out axially between this sealed position shown here and the lowered open position as shown in FIG. 11.

FIG. 12 illustrates the working method of this sealing element 30. The sealing element 30 is in its lower position due to gravity for upright bottle or upright container and seals the connection. If the container or the bottle is tilted for the pouring out clearly by more than 90°, preferably by about 120° or more, the sealing element 30 slides towards the outside due to gravity to the open position shown in such tilted pouring position. Thus the sealing element 30 works in such a way that the closure is opened only if the container flask is tilted by a minimum amount and consequently takes a pouring out position, which has at least at an inclined position of 30°. In this inclined position, the contents flow out smoothly from both containers and certainly in the desired quantitative ratio. FIG. 13 shows the sealing element 30 separately in a perspective view seen from the front and FIG. 14 shows it from behind.

The invention claimed is:

1. Container closure to simultaneously pour out two separate liquids with a specified quantitative ratio from a container, inside which there is a separate inner container, in which the container closure is, characterised by the fact, that it forms a mouth cap (1) for the receiving and for the holding of the inner container and pouring out its contents, which tapers upward conically into a straight concentric spout (2) with an interior space (11), and that a larger, closable spout neck (4) having a projection that radially projects at the bottom is placed concentrically around the straight spout (2) of this mouth cap (1), in which this projection (5) is supported with at least two supporting braces (6) on the shoulder (7) formed by the conical taper and a flow opening (9), which encircles up to the supporting braces, is left open between this shoulder (7) on one side and the inside edge (8) of the projection (5) and of the larger spout neck (4) on the other side, and that the supporting braces (6) and the radial projection (5) are passed through by at least one hole (10), each of which communicate with the inside of the mouth cap (1) and with the space (16) outside the larger spout neck (4) so that, the liquid flowing out from outside the inner container is deflected sideways at least twice in its flow direction till the discharge from the closure.

2. Container closure to simultaneously pour out two separate liquids with a specified quantitative ratio from a container according to claim 1, characterised by the fact, that the mouth cap (1) has an internal thread (13) for the screwing of a matching inner container (23), and that the larger spout neck (4) has an external thread, on which a suitable closure cap (3) can be screwed on.

3. Container closure to simultaneously pour out two separate liquids with a specified quantitative ratio from a container according to claim 1, characterised by the fact, that the mouth cap (1) has an internal thread (13) for the screwing of a matching inner container (23), and that a threaded connection (14) is formed concentric to the radial projection (5) outside around the larger spout neck (4) and the upper mouths of the holes (10), to which a suitable closure cap (3) can be screwed on.

4. Container closure to simultaneously pour out two separate liquids with a specified quantitative ratio from a container according to claim 1, characterised by the fact, that the projection (5) is supported with three supporting braces (6) arranged distributed around the circumference on the shoulder (7) formed by the conical tapering.

5. Container closure to simultaneously pour out two separate liquids with a specified quantitative ratio from a container according to claim 1, characterised by the fact, that the projection (5) is supported with four supporting braces (6) distributed around the circumference on the shoulder (7) formed by the conical tapering.

6. Container closure to simultaneously pour out two separate liquids with a specified quantitative ratio from a container according to claim 1, characterised by the fact, that the mouths of the spout (2) and the larger spout neck (4) arranged concentrically around it lie in the same plane.

7. Container closure to simultaneously pour out two separate liquids with a specified quantitative ratio from a container according to claim 1, characterised by the fact, that the mouths of the spout (2) and the larger spout neck (4) arranged concentrically around it lie in the same plane and have sharp mouth edges.

8. Container closure to simultaneously pour out two separate liquids with a specified quantitative ratio from a container according to claim 1, characterised by the fact, that the mouth of the threaded connection lying concentric around the larger spout neck (4) on the radial projection (5) is moved back against the mouth of the spout neck (4), so that the inner plane of a closure cap that can be screwed on to the threaded connection can be pressed leak-proof on the mouths of spout neck (4) and the inner spout (2) by means of screwing on.

9. Container closure to simultaneously pour out two separate liquids with a specified quantitative ratio from a container according to claim 1, characterised by the fact, that the closure cap (3) widens at its bottom edge in the form of a trumpet-like mouth and bottoms out in the shoulder (20) of a closure cap sleeve (19) via a surrounding perforation line (21) working as initial tamper-proof guarantee, which can be put on from above via the radial projection (5) of the container closure and presses this leak-proof on the mouth of the container to be equipped by screwing on or striking on the container connection.

10. Container closure to simultaneously pour out two separate liquids with a specified quantitative ratio from a container according to claim 9, characterised by the fact, that the closure cap sleeve (19) is provided with a thread with locking teeth, which engage during the screwing on the thread of the container connection with locking teeth on the same.

11. Container closure according to claim 1, characterised by the fact, that it contains a movable sealing element (27), which is carried movable in the axial direction in the space (16) between the interior surface of the threaded connection (14) and the exterior surface of the larger spout neck (4), can flow through in the axial direction there and forms at the front end a sealing surface (28,29) for the inner (11) and the outer spout neck (4).

12. Container closure according to claim 1, characterised by the fact, that container closure contains a movable sealing element (27), which seals from vertical to shortly over a horizontal position of the container closure the inside (12) of the larger connection (4) by sealing lip (28) and the inner space (11) by sealing plug (29).

13. Container closure according to claim 12, characterised by the fact, that the movable sealing element (27) seals the connection (4, 11) with its sealing surfaces (28, 29) due to gravity for upright position of the container and, for the inclination of the container to pouring out position, that is more than 90°, the sealing element (27) can be moved towards the front due to gravity and liquid pressure acting on its sealing surfaces (28,29), so that it opens.

* * * * *